US005727288A

United States Patent [19]

Byon

[11] Patent Number: 5,727,288

[45] Date of Patent: Mar. 17, 1998

[54] APPARATUS FOR SEPARATING DOORS FRM A BODY OF A MOTOR VEHICLE

[75] Inventor: Sung-Kwang Byon, Seoul, Rep. of Korea

[73] Assignee: Daewoo Electronics Co., Ltd., Seoul, Rep. of Korea

[21] Appl. No.: 578,182

[22] Filed: Dec. 29, 1995

[30] Foreign Application Priority Data

Mar. 22, 1995 [KR] Rep. of Korea ..... 95-6042

[51] Int. Cl.[6] ..... E05D 5/10; E05D 7/10

[52] U.S. Cl. ..... 16/254; 16/221; 16/386

[58] Field of Search ..... 16/221, 254, 386, 16/86 C; 89/1.14

[56] References Cited

U.S. PATENT DOCUMENTS 2,184,201 12/1939 Schonitzer ..... 16/86 C
5,152,030 10/1992 Cogo ..... 16/86 C

FOREIGN PATENT DOCUMENTS 0433940 6/1991 European Pat. Off. ..... 16/221
2-34452 2/1990 Japan ..... 16/221

*Primary Examiner*—Chuck Mah
*Assistant Examiner*—Donald M. Gurley
*Attorney, Agent, or Firm*—Beveridge, DeGrandi, Weilacher & Young LLP

[57] ABSTRACT

Disclosed an apparatus of a vehicle for separating a door including a first hinge, a second hinge, a door check assembly, and a door separating part. By using the apparatus, the door can be easily separated from a body of the vehicle when the body is deformed by a collision and/or overturned. By separating hinges and a door checker by a first, a second, and a third explosive respectively, the door can be easily separated from the body of the vehicle which can not be opened due to deformation by an accident such as a collision or overturning. The wounded remaining in the compartment of the vehicle, can separate the door by using the apparatus, and can escape from the accident vehicle by themselves. Also, a rescuer can easily and rapidly rescue the wounded from the vehicle without rescue equipment.

8 Claims, 4 Drawing Sheets

APPARATUS FOR SEPARATING DOORS FRM A BODY OF A MOTOR VEHICLE

BACKGROUND OF THE INVENTION

1. Field of the Invention

The present invention relates to a door apparatus of a motor vehicle, and more particularly to an apparatus for easily separating doors from the body of a motor vehicle when the body is seriously deformed by a shock such as a collision of the motor vehicle.

2. Description of the Prior Art

A door mounting apparatus of a motor vehicle, is a device for pivotally mounting a door to a body of a motor vehicle. The door is pivotally mounted to the body by means of an upper hinge fixed to the upper side portion of the door, and a lower hinge fixed to the lower side portion thereof. Additionally, an opening angle of the door is restricted by a door check assembly which is installed between the upper and lower hinges, and the open state of the door can be maintained due to the presence of the door check assembly.

If a vehicle collides against another vehicles or is overturned by the collision, then the passengers in the compartment are injured due to the collision or the overturning of the vehicle. If such an accident occurs, the wounded persons (a driver and/or passengers) should escape from the vehicle, and then emergency medical treatment is required. However, if a vehicle collides against another vehicle or is overturned by the collision, then the door may not open because of the deformation of the door or the vehicle's body due to the shock. Thus, the driver and passengers in the crushed vehicle can not open the door to escape from the vehicle without help.

In a conventional door mounting apparatus, for rescuing the wounded driver and/or passenger in the accident vehicle, a rescuer should break the window of the vehicle door, and cut the door with rescue equipment to separate the door from the vehicle body. Thus, the wounded persons can be rescued only after the door is cut and separated from the vehicle body.

In order to rescue the wounded persons, the rescuers with rescue equipment must arrive at the place where the accident has taken place. Therefore, the wounded have no choice but to wait for the rescuer.

Moreover, if a potential danger such as an explosion is predicted by the collision and/or overturning of the vehicle, then the wounded should escape from the accident vehicle without waiting for the rescuer. However, if the wounded can not escape the accident vehicle because they can not open and cut the deformed door for themselves, it would be a serious problem.

SUMMARY OF THE INVENTION

Therefore, it is an object of the present invention to provide an apparatus for easily separating a door from a vehicle's body when the vehicle's body is deformed by a collision and/or overturn of the vehicle.

To achieve the above object of the present invention, there is provided an apparatus for separating a door from a body of a vehicle, the apparatus comprises:

a first hinge including a first fixing member secured to a body of the vehicle, a first pivoting member fixed at the upper side of the door, and a first sleeve for joining the first fixing member and the first pivoting member;

a second hinge including a second fixing member secured to the body, a second pivoting member fixed at the lower side of the door, and a second sleeve for joining the second fixing member and the second pivoting member;

a door check assembly including a door check bracket 60 secured to the body, a door check link, a door check sleeve for joining the door check bracelet and the door check link, and a door checker secured to the door for restricting the opening angle of the door check link; and a means for separating the first hinge, the second hinge, and the door check assembly from the body, wherein the means is installed in the first hinge, the second hinge, and the door check assembly.

The door separating means includes a first separating section installed in the first sleeve for separating the upper hinge, a second separating section installed in the second sleeve for separating the lower hinge, a third separating section installed in the door check sleeve for separating the door check assembly, and a power supply for supplying an electric power the first, second, and third separating sections when a detonating switch is closed.

The first separating section includes a first explosive filled in said first sleeve for destroying said first sleeve, a first detonator inserted to said first explosive for exploding said first explosive when said detonating switch is closed, and a first plug for closing said first sleeve.

By an explosion of the first explosive, the portion pivotally connected of the first hinge is separated in the radial direction of the first sleeve.

According to the present invention, when the passengers who remain in the vehicle are not wounded, they can easily separate the door and escape the vehicle by using the apparatus according to the present invention for themselves without any outside help.

Moreover, since the door can be easily separated and opened by using the apparatus according to the present invention, the rescuer need not to carry rescue equipment for rescuing the wounded in the crashed vehicle.

BRIEF DESCRIPTION OF THE DRAWINGS

The above objects and other advantages of the present invention will become more apparent by describing in detail the preferred embodiment thereof with reference to the attached drawings, in which.

DESCRIPTION OF THE PREFERRED EMBODIMENT

Hereinafter, the present invention will be described in detail in the following embodiment together with the accompanying drawings.

Figure 1:
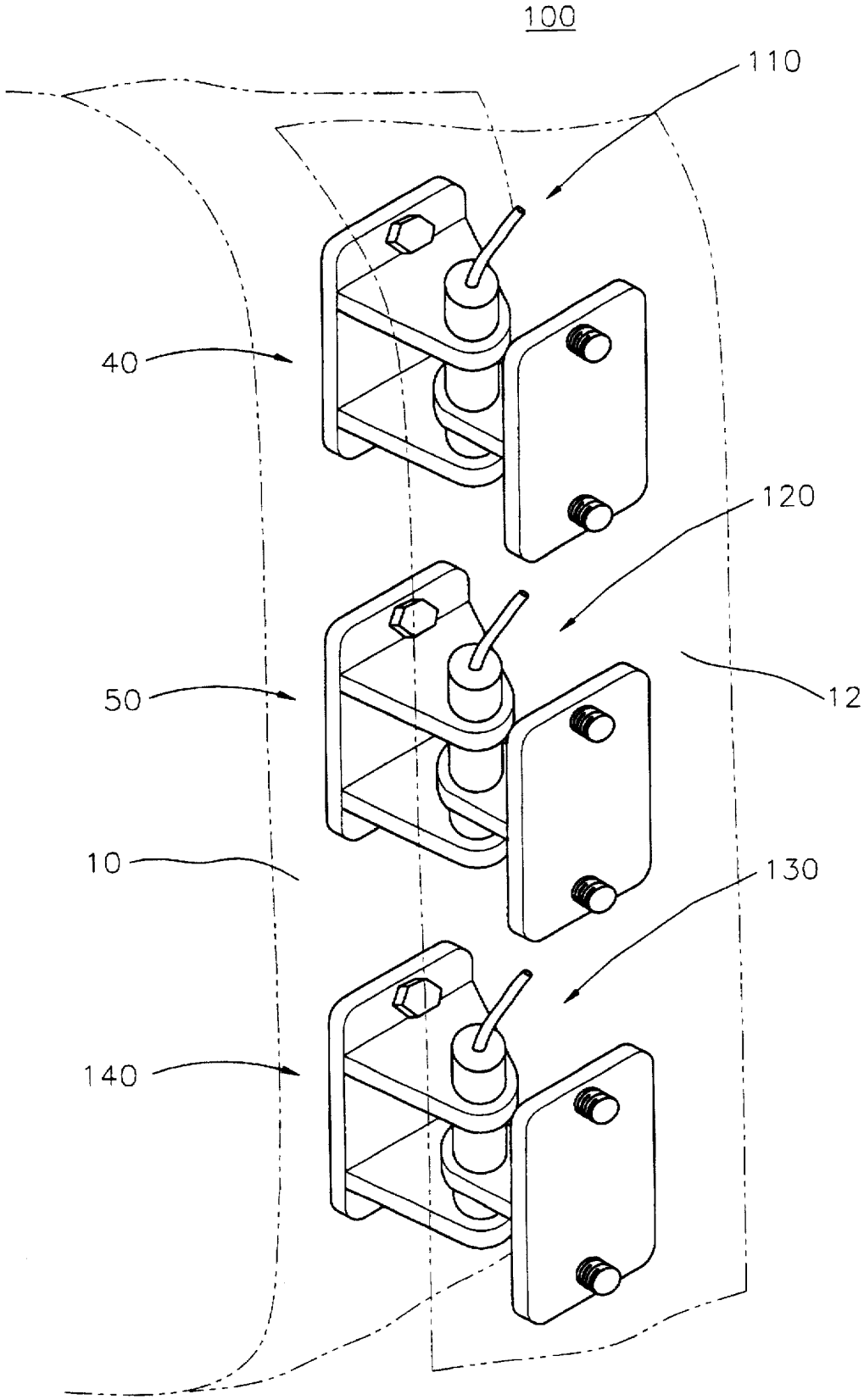
FIG. 1 is a perspective view for showing a door separating apparatus according to one embodiment of the present invention.

FIG. 1 is a perspective view for showing a door separating apparatus 100 of a vehicle according to a preferred embodiment of the present invention. As shown in FIG. 1, door separating apparatus 100 includes an upper hinge 40, a lower hinge 140, a door check assembly 50, and a door separating part 200 for first and second hinges 40 and 140, and door check assembly 50.

Door separating part 200 includes a first separating section provided in upper hinge 40 for destroying upper hinge 40, a second separating section 130 provided in lower hinge 140 for destroying lower hinge 140, a third separating section 120 provided in door check assembly 50 for destroying door check assembly 50, and a power supply for supplying the electric power to first, second, and third separating section 110, 130, and 120 when a detonating switch 82 is closed (ON).

Due to the presence of upper and lower hinges 40 and 140, door 10 is pivotally mounted to a body 12 of a vehicle. Door check assembly 50 maintains the opened state of door, and restricts the opening angle of door 10 so that door 10 can not be not opened over the predetermined angle.

Figure 2:
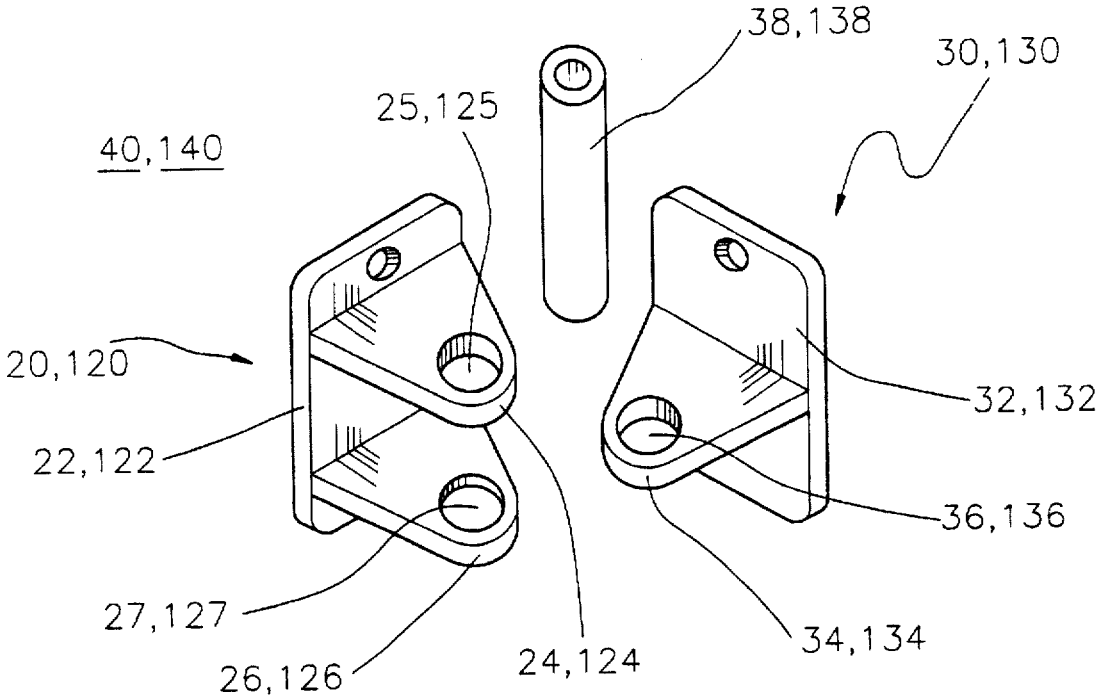
FIG. 2 is an exploded perspective view of a hinge as shown in FIG. 1.
Figure 3:
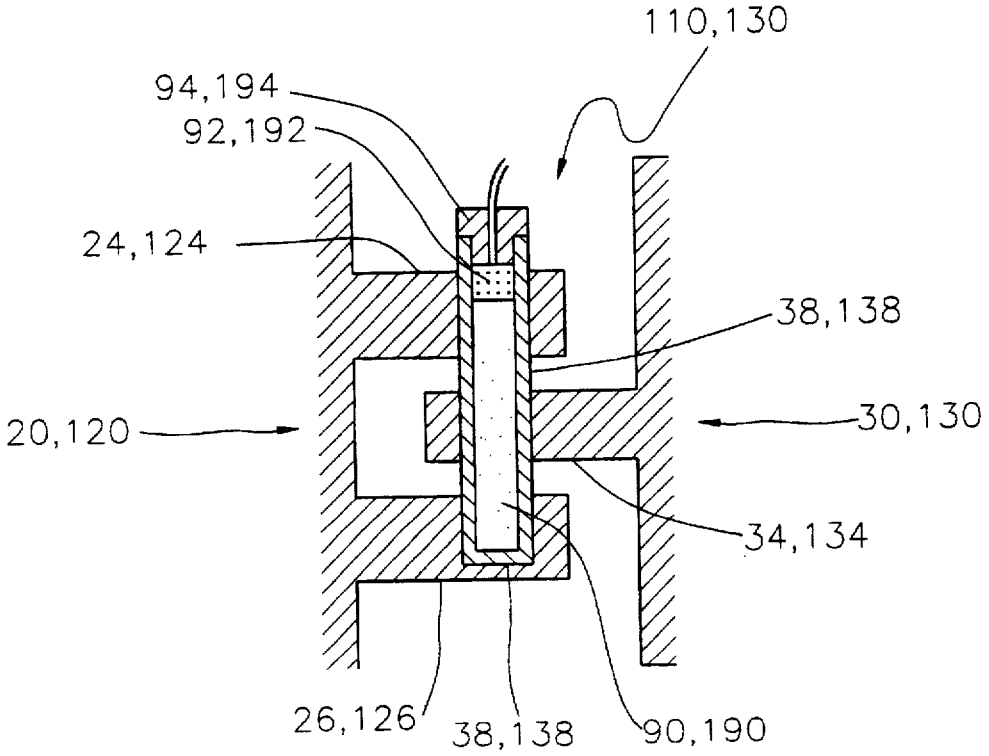
FIG. 3 is a cross-sectional view for showing an associated state of the hinge and a first separating section.

FIGS. 2 and 3 illustrate upper hinge 40 and lower hinge 140. As shown FIGS. 2 and 3, upper hinge 40 has a first fixing member 20 secured to body 12, a first pivoting member 30 fixed at the side of door 10, and a first sleeve 38 for pivotally joining first fixing member 20 and first pivoting member 30.

First fixing member 20 has a first fixing body 22 for securing first fixing member 20 to body 12, a first upper rib 24, and a first lower rib 26, which are integrally formed. A first penetrated hole 25 is formed at first upper rib 24, and a first support hole 27 is formed at first lower rib 26. First support hole 27 has the same diameter as first upper penetrated hole 25, and is closed at the lower portion thereof.

First pivoting member 30 has a first pivoting body 32 for securing first pivoting member 30 to door 10, and a pivoting rib 34 having a first connecting hole 36 formed thereat, which are integrally formed. First connecting hole 36 has the same diameter as first upper penetrated hole 25.

First sleeve 38 for combining first fixing member 20 with first pivoting member 30, is formed to have a cylindrical shape and its lower portion is closed.

Upper hinge 40 is assembled in the way that first fixing member 20 is combined with first pivoting member 30 by first sleeve 38. First sleeve 38 is inserted into first support hole 27 via first penetrated hole 25 and first connecting hole 36. First sleeve 38 is inserted into first support hole 27 via first penetrated hole 25 and first connecting hole 36. Meanwhile, first fixing member 20 is secured to body 12 by means of a screw such as a bolt, and first pivoting member 30 is secured to door 10 by means of a screw such as a bolt.

Lower hinge 140 includes a second fixing member 120 secured to body 12, a second pivoting member 130 fixed at the side of door 10, and a second sleeve 138 for combining second fixing member 120 with second pivoting member 130.

Second fixing member 120 has a second fixing body 122 for securing second fixing member 120 to body 12, a second upper rib 124, and a second lower rib 126, which are integrally formed. A second penetrated hole 125 is formed at second upper rib 124, and a second support hole 127 is formed at second lower rib 126. Second support hole 127 has the same diameter as second upper penetrated hole 125, and the lower portion thereof is closed.

Second pivoting member 130 has a second pivoting body 132 for securing second pivoting member 130 to door 10, and a second pivoting rib 134 having a second connecting hole 136 formed therein, which are integrally formed. Second connecting hole 136 has the same diameter as second upper penetrated hole 125.

Second sleeve 138 for combining second fixing member 120 with second pivoting member 130, is formed to have a cylindrical shape, and its lower portion is closed.

Lower hinge 140 is assembled in the way that second fixing member 120 is combined with second pivoting member 130 by second sleeve 138. Second sleeve 138 is inserted into second support hole 127 via second penetrated hole 125 and second connecting hole 136. Meanwhile, second fixing member 120 is secured to body 12 by means of a screw such as a bolt, and second pivoting member 130 is secured to door 10 by means of a screw such as a bolt.

Figure 4:
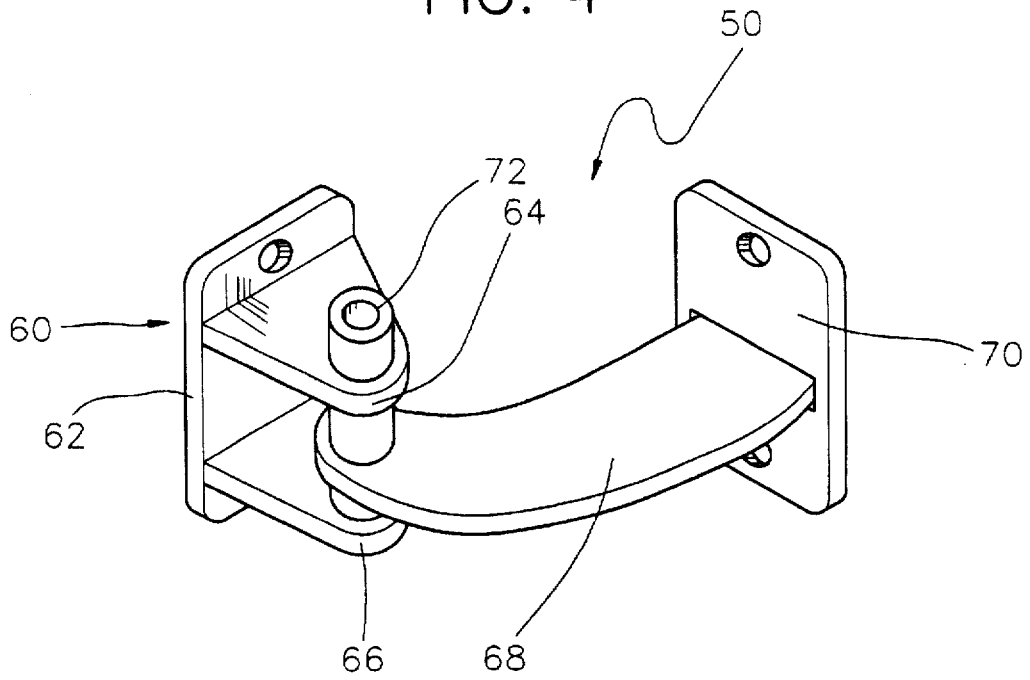
FIG. 4 is an perspective view for showing an associated state of the door check assembly as shown in FIG. 1.
Figure 5:
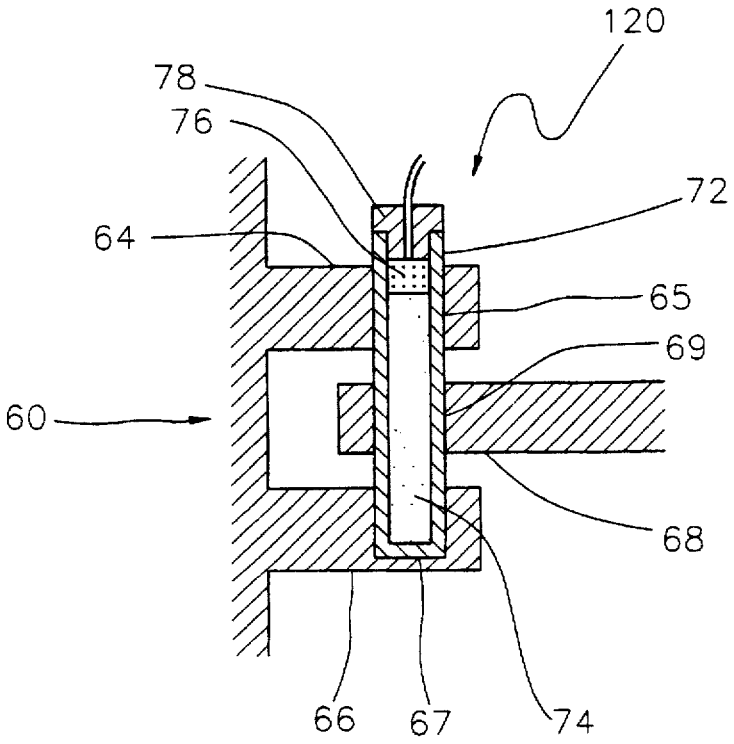
FIG. 5 is a cross-sectional view for showing an associated state of the door check assembly and a third separating section.

FIGS. 4 and 5 illustrate door check assembly 50. As shown in FIGS. 4 and 5, door check assembly 50 has a door check bracket 60 secured to body 12, a door check link 68, a door check sleeve 72 for combining door check bracket 60 with door check link 68, and a door checker 70 secured to door 10 for restricting an opening angle of door check link 68.

Door check bracket 60 has a door check bracket body 62 for securing door check bracket 60 to body 12, a third upper rib 64, and a third lower rib 66, which are integrally formed. A third penetrated hole 65 is formed at third upper rib 64, and a third support hole 67 is formed at third lower rib 66. Third support hole 67 has the same diameter as third upper penetrated hole 65, and the lower portion thereof is closed.

Door check link 68 has a third connecting hole 69 formed therein with same diameter of one of third upper penetrated hole 65, whose pivoting is restricted by door check 70.

Door check sleeve 72 for combining door check bracket 60 with door check link 68, is formed to have a cylindrical shape and its lower portion is closed.

First separating section 110 which separates upper hinge 40 from body 10, includes a first explosive 90 which is filled in first sleeve 38, a first detonator 92 which is inserted into first explosive 90, and a first plug 94 for closing first sleeve 38.

If first detonator 92 provided the explosive force to first explosive 90, then first explosive 90 exploded rapidly. At this time, upper hinge 40 which is pivotally assembled by means of first sleeve 38, is destroyed. First plug 94 restricts the explosion of first explosive 90 from advancing in the upward direction.

Second separating section 130 which separates lower hinge 140 from body 10 includes a second explosive 190 which is filled in second sleeve 138, a second detonator 192 which is inserted into second explosive 190, and a second plug 194 for closing second sleeve 138.

If second detonator 192 provided the explosive force to second explosive 190, then second explosive 190 explodes rapidly. At this time, lower hinge 140 which is pivotally assembled by means of second sleeve 138, is destroyed. Second plug 194 restricts the explosion of second explosive 190 from advancing in the upward direction.

Third separating section 120 which separates door check assembly 50, includes a third explosive 74 filled in door check sleeve 72, a third detonator 76 inserted into third explosive 74, and a third plug 78 for closing door check sleeve 72.

If third detonator 76 provided explosive force to third explosive 74, then third explosive 74 explodes rapidly. At this time, door check assembly 50 which is pivotally assembled by means of door check sleeve 72, is destroyed.

Third plug 78 restricts the explosion of third explosive 74 from advancing in the upward direction.

Figure 6:
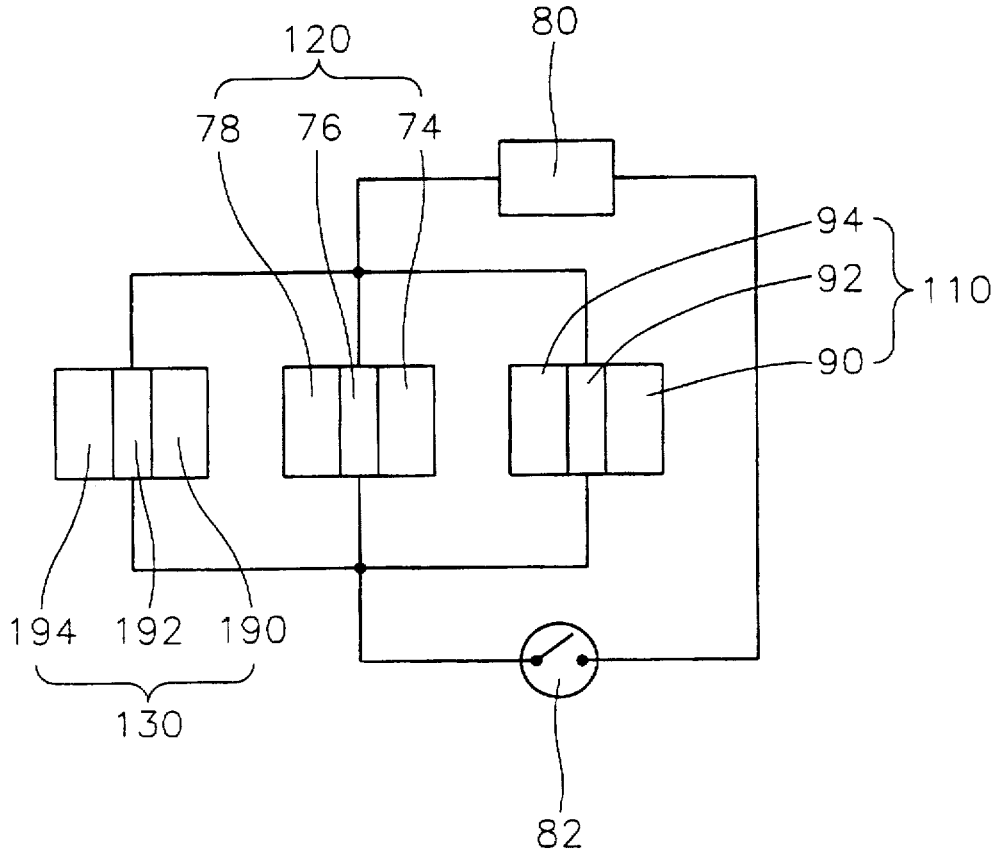
FIG. 6 is a block diagram for showing the electrical connection of the door separating apparatus.

First, second, and third detonator 92, 192, and 76 of first, second, and third separating section 110, 130, and 120, as shown in FIG. 6 are electrically connected to a power supply 80 and a detonating switch 82. A variety of explosive such as dynamite and an explosive composition may be utilized as first, second, and third explosive 92, 192, and 76.

If detonating switch 82 is closed by a driver or a rescuer, then first separating section 110 separates upper hinge 40 from body 10, second separating section 130 separates lower hinge 140 from body 10, and third separating section 120 separates door check assembly 90 from body.

Door 10 is usually opened and/or closed by pivoting around upper hinge 40 and lower hinge 140. Door check assembly 50 maintains the opened sate of door 10, and restricts the opening angle of door 10 so that door 10 can not be not opened over the predetermined angle.

However, if a vehicle in the closed state of door 10 collides and/or overturns, then body 12 of vehicle is deformed so that door 10 can not be opened regardless of the operation of a door locking device (not shown).

In order for the wounded in the vehicle to escape, detonating switch 82 is closed by the wounded or the rescuer outside the vehicle. By closing detonating switch 82, power supply 80 supplies the electric power to first explosive 90, second explosive 190 first explosive 90, and third explosive 74 so that first, second, and third explosives 90, 190, and 74 are exploded by first, second, and third detonator 92, 192, and third detonators 76, respectively.

Because first sleeve 38 is closed by first plug 94 and first supporting hole 27, first explosive 90 explodes in the radial direction of first sleeve 38. Therefore, first explosive 92 destroys first sleeve 38, first upper rib 24, first lower rib 26, and first pivoting rib 34. Thus, upper hinge 40 is destroyed and separated from body 10 by the explosion of first explosive 90.

Moreover, because second sleeve 138 is closed by second plug 194 and second supporting hole 127, second explosive 190 explodes in radial direction of second sleeve 138. Therefore, second explosive 192 destroys second sleeve 138, second upper rib 124, second lower rib 126, and second pivoting rib 134. Thus, lower hinge 140 is destroyed and separated from body 10 by the explosion of second explosive 190.

Meanwhile, because door check sleeve 72 is closed by third plug 78 and third supporting hole 67, third explosive 74 explodes in radial direction of door check sleeve 72. Therefore, third explosive 74 destroys door check sleeve 72, third upper rib 64, third lower rib 66, and door check link 68. Thus, door check assembly 50 is destroyed and separated from body 10 by the explosion of third explosive 74.

Consequently, first and second hinges 40 and 140, and door check assembly 50 are destructed by first, second, and third explosive 90, 190, and 74 so that door 10 is separated from body 12 of the vehicle. The wounded in the vehicle can escape therefrom through the separated door 10. If the wounded can not escape the vehicle, someone outside can rescue the wounded via the separated door 10.

As described above, by using the apparatus for separating a door of vehicle 100 according to the present invention, the door can be easily opened even if the door can not be opened by the deformation of the body of vehicle.

Meantime, if the passengers remaining in the vehicle are not wounded, they can separate the door by themselves and escape the vehicle by using the apparatus according to the present invention without any outside help.

Moreover, because the door can be easily separated from the vehicle's body and opened by using the apparatus according to the present invention, the rescuer need not carry rescue equipment for rescuing the wounded in the accident vehicle.

While the present invention has been particularly shown and described with reference to preferred embodiment thereof, it will be understood by those skilled in the art that the foregoing and other changes in form and details may be made therein without departing from the spirit and scope of the present invention.

What is claimed is:

1. An apparatus for separating a door of a vehicle, said apparatus comprising:

a first hinge including a first fixing member secured to a body of the vehicle, a first pivoting member fixed at an upper side portion of the door, and a first sleeve combining said first fixing member with said first pivoting member;

a second hinge including a second fixing member secured to the body, a second pivoting member fixed at a lower side portion of the door, and a second sleeve combining said second fixing member with said second pivoting member;

a door check assembly including a door check bracket secured to the body, a door check link, a door check sleeve combining said door check bracket with said door check link, and a door checker secured to the door for restricting an opening angle of said door check link; and a means for separating said first fixing member from said firsts pivoting member said second fixing member from said second pivoting member, said door check bracket from said door check link, said separating means being provided at said first hinge, said second hinge, and said door check assembly, said separating means having a first separating section installed in said first sleeve for separating said upper hinge, a second separating section installed in said second sleeve for separating said lower hinge, a third separating section installed in said door check sleeve for separating said door check assembly; a detonating switch; and, a power supply connected to said switch for supplying electric power to said first, second and third separating sections when the detonating switch is closed whereby a passenger in the vehicle may separate the door from the vehicle by closing the detonating switch.

2. An apparatus as claimed in claim 1, wherein said first fixing member has a first fixing body for securing said first fixing member to the body, a first upper rib having a first penetrated hole, and a first lower rib having a first support hole, wherein a diameter of the first supporting hole is the same as first penetrated hole, and a lower portion of the first supporting hole is closed; said first pivoting member has a first pivoting body for securing said first pivoting member to the side of this door, and a first pivoting rib having a first connecting hole; and said first sleeve has a cylindrical shape whose lower portion is closed; and said first sleeve is inserted into the first supporting hole by penetrating through the first penetrated hole and the first connecting hole.

3. An apparatus as claimed in claim 1, wherein said second fixing member has a second fixing body for securing said second fixing member to the body, a second upper rib having a second penetrated hole, and a second lower rib having a second support hole, wherein a diameter of the second supporting hole is the same as second penetrated hole, and a lower portion of the second supporting hole is closed; said second pivoting member has a second pivoting body for securing said second pivoting member to the side of the door, and a second pivoting rib having a second connecting hole; said second sleeve has a cylindrical shape whose lower portion is closed; and said second sleeve is inserted into the second supporting hole by penetrating through the second penetrated hole and the second connecting hole.

4. An apparatus as claimed in claim 1, wherein said door check bracket has a door check bracket body for securing said door check bracket to the body, a third upper rib having a third penetrated hole, and a third lower rib having a third support hole, wherein a diameter of the third supporting hole is the same as the third penetrated hole, and a lower portion of the third supporting hole is closed; said door check link has a third connecting hole whose diameter is same of the diameter of the third supporting hole; said door check sleeve has a cylindrical shape whose lower portion is closed; and said door check sleeve is inserted into the third supporting hole by penetrating through the third penetrated hole and the third connecting hole.

5. An apparatus as claimed in claim 1 wherein said first separating section comprises:

a first explosive filled in said first sleeve for destroying said first sleeve;

a first detonator inserted into said first explosive for exploding said first explosive when said detonating switch is closed; and a first plug for closing said first sleeve.

6. An apparatus as claimed in claim 1, wherein said second separating section comprises:

a second explosive filled in said second sleeve for destroying said second sleeve;

a second detonator inserted to said second explosive for exploding said second explosive when said detonating switch is closed; and a second plug for closing said second sleeve.

7. An apparatus as claimed in claim 1, said third separating section comprising:

a third explosive filled in said door check sleeve for destroying said door check sleeve;

a third detonator inserted to said third explosive for exploding said third explosive when said detonating switch is closed; and a third plug for closing said door check sleeve.

8. An apparatus for separating a door of vehicle comprising:

a first hinge including a first fixing member which has a first fixing body secured to a body of the vehicle, which has a first upper rib having a first penetrated hole, and which has a first lower rib having a first supporting hole, a first pivoting member which has a first pivoting body securing said first pivoting member to the side of the door, and which has a first pivoting rib having a first connecting hole, and a first sleeve joining said first fixing member and said first pivoting member, wherein said first hinge is connected by inserting said first sleeve through the first penetrated hole, the first connecting hole, and into the supporting hole, wherein diameters of said first penetrated hole and said first supporting hole, and said first connecting hole are the same, lower portion of said first supporting hole is closed;

a second hinge including a second fixing member which has a second fixing body secured to the body, which has a second upper rub having a second penetrated hole, and which has a second lower rib having a second supporting hole, a second pivoting member which has a second pivoting body securing said second pivoting member to the side of the door, and a second pivoting rib having a second connecting hole, and a second sleeve joining said second fixing member and said second pivoting member, wherein said second hinge is connected by inserting said second sleeve through the second penetrated hole, the second connecting hole, and into the supporting hole, wherein diameters of said second penetrated hole and said second supporting hole, and said second connecting hole are same, lower portions of said second supporting hole is closed;

a door check assembly including a door check bracket which has a door check bracket body secured to the door, which has a third upper rib having a third penetrated hole, and which has a third lower rib having a third supporting hole, a door check link having a third connecting hole formed therein, a door checker secured to the door for restricting an opening angle of said door check link, and a door check sleeve joining said door check bracket and said door check link, wherein said door check assembly is connected by inserting said door check sleeve through the third penetrated hole, the third connecting hole, and into the supporting hole, and wherein the diameters of the third penetrated hole and the third supporting hole, and the third connecting hole are same, lower portion of the third supporting hole is closed;

a detonation switch;

a power supply connect to said detonation switch for supplying an electric power when the detonating switch is closed;

a first separating section installed in said first sleeve for separating said first hinge including a first explosive filled in said first sleeve for destroying said first sleeve, a first detonator inserted to said first explosive for exploding said first explosive when said detonating switch is closed, and a first plug for closing said first sleeve;

a second separating section installed in said second sleeve for separating said second hinge including a second explosive filled in said second sleeve for destroying said second sleeve, a second detonator inserted to said second explosive for exploding said second explosive when said detonating switch is closed, and a second plug for closing said second sleeve; and a third separating section installed in said door check sleeve for separating said door check assembly including a third explosive filled in said door check sleeve for destroying said door check sleeve, a third detonator inserted to said third explosive for exploding said third explosive when said detonating switch is closed, and a third plug for closing said door check sleeve, and, mean connecting said first, second and third detonators to said detonator switch.

* * * * *